United States Patent [19]

Nilssen

[11] Patent Number: 5,015,923

[45] Date of Patent: May 14, 1991

[54] EXTRA EFFICIENT ELECTRONIC BALLAST FOR FLUORESCENT LAMPS

[76] Inventor: Ole K. Nilssen, Caesar Dr., Rte. 5, Barrington, Ill. 60010

[21] Appl. No.: 513,053

[22] Filed: Apr. 26, 1990

Related U.S. Application Data

[63] Continuation of Ser. No. 907,229, Sep. 15, 1986, abandoned.

[51] Int. Cl.[5] ..... H05B 41/36

[52] U.S. Cl. ..... 315/307; 315/209 R; 315/256; 315/DIG. 5

[58] Field of Search ..... 315/307, 308, 313, DIG. 5

[56] References Cited

U.S. PATENT DOCUMENTS

| | | | |
|---|---|---|---|
| Re. 31,758 | 12/1984 | Nilssen | 331/113 A |
| 4,438,372 | 3/1984 | Zuchtriegel | 315/224 |
| 4,554,487 | 11/1985 | Nilssen | 315/224 |

*Primary Examiner*—Eugene R. LaRoche
*Assistant Examiner*—Ali Neyzari

[57] ABSTRACT

A power-line-operated ballast for two fluorescent lamps has a self-oscillating half-bridge inverter whose 30 kHz squarewave output voltage is switchably connected either with an auxiliary transformer and/or with a series-resonant L-C circuit. The lamps are series-connected across the tank capacitor of the L-C circuit; the lamps' cathodes are connected with individual outputs of the auxiliary transformer.

When power is initially applied to the ballast, only the auxiliary transformer is connected with the inverter output, thereby providing heating power to the lamps' cathodes. After about 1.5 second, the L-C circuit is automatically connected with the inverter output, and the lamps then ignite in ordinary Rapid-Start manner. The auxiliary transformer is automatically disconnected at the time the L-C circuit is connected, thereby providing for extra high efficiency operation.

In the event the lamps become disconnected or inoperative, the inverter will become disabled within about 15 milli-seconds. However, after about 5 seconds, the inverter starts again. At that time, the L-C circuit has become disconnected and the auxiliary transformer has become re-connected.

20 Claims, 1 Drawing Sheet

EXTRA EFFICIENT ELECTRONIC BALLAST FOR FLUORESCENT LAMPS

This application is a continuation of Ser. No. 907,229, filed Sept. 15, 1986, now abandoned.

BACKGROUND OF THE INVENTION

Field of Invention

The present invention relates to electronic ballasts for fluorescent lamps, particularly of a kind wherein cathode heating power is removed after lamp ignition.

SUMMARY OF THE INVENTION

Objects of the Invention

An object of the present invention is that of providing for an extra-high-efficiency ballast for fluorescent lamps.

These, as well as other objects, features and advantages of the present invention will become apparent from the following description and claims.

BRIEF DESCRIPTION

In its preferred embodiment, the present invention constitutes a power-line-operated ballast for two fluorescent lamps. This ballast comprises a self-oscillating half-bridge inverter whose 30 kHz squarewave output voltage is—by way of thermally responsive switch means—connected either with an auxiliary transformer and/or with a series-resonant L-C circuit. The lamps are series-connected across the tank capacitor of the L-C circuit. A voltage-limiting Varistor is also connected across the tank capacitor. The lamps' cathodes are connected with individual outputs of the auxiliary transformer.

When power is initially applied to the ballast, only the auxiliary transformer is connected with the inverter output, thereby providing heating power to the lamps' cathodes. After about 1.5 second, the L-C circuit is automatically connected with the inverter output, and the lamps then ignite in ordinary Rapid-Start manner. The auxiliary transformer is automatically disconnected at the time the L-C circuit is connected, thereby providing for extra high efficiency operation.

In the event the lamps were to become disconnected or inoperative, the inverter will become disabled within about 15 milli-seconds, thereby protecting the inverter and the Varistor from overload. However, after about 5 seconds, the inverter starts again. By that time, the L-C circuit has become disconnected and the auxiliary transformer has become re-connected.

For safety-reasons, if any lamp is removed from but one of its sockets, the inverter becomes disabled within about 15 milli-seconds, thereby preventing the possibility of a serious electric shock.

DESCRIPTION OF THE PREFERRED EMBODIMENT

Details of Construction

Figure 1:
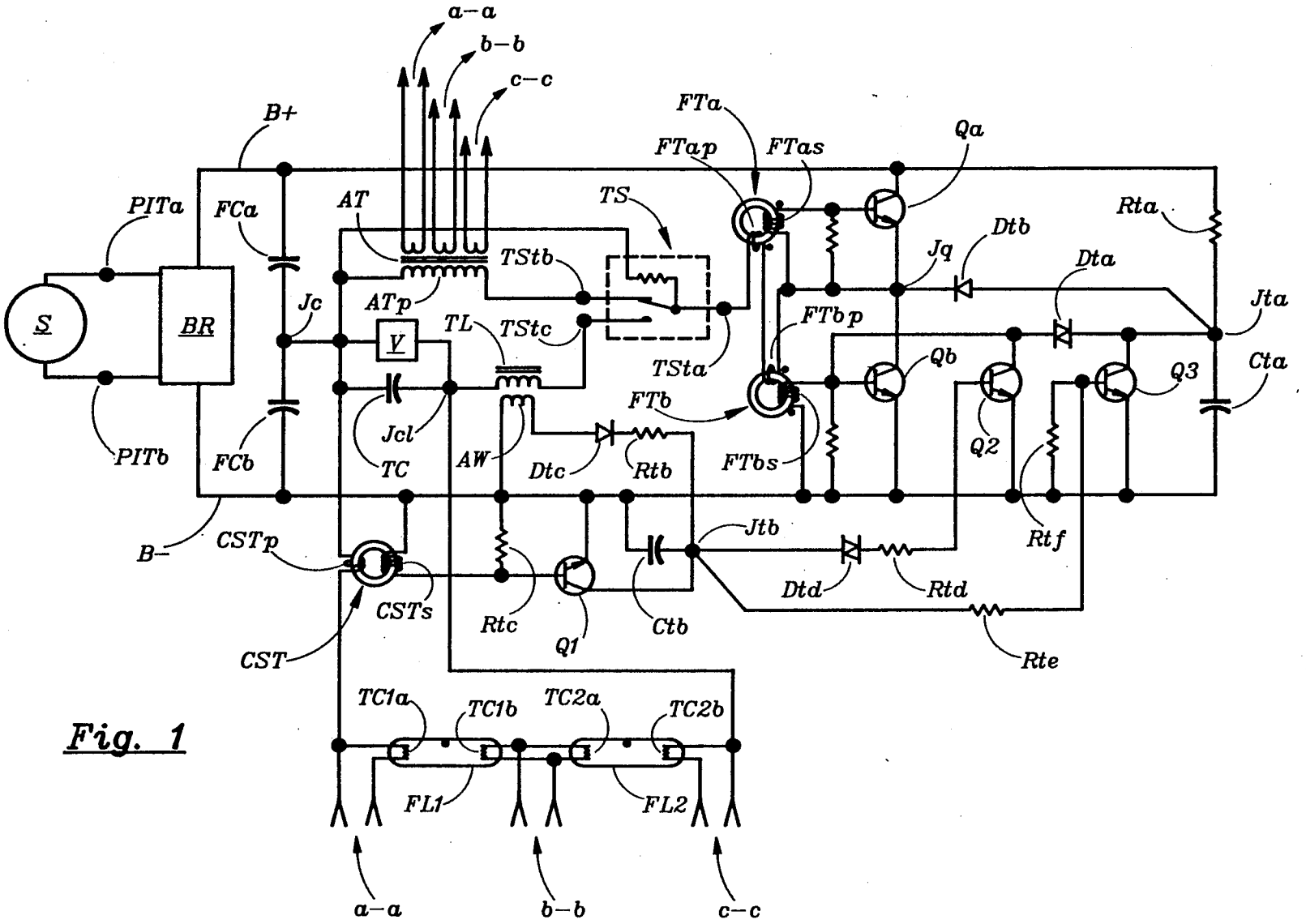
FIG. 1 provides a basic electrical circuit diagram of the preferred embodiment of the invention.

FIG. 1 schematically illustrates the electrical circuit arrangement of the preferred version of the present invention.

In FIG. 1, a source S of ordinary 277 Volt/60 Hz power line voltage is applied to power input terminals PITa and PITb; which terminals, in turn, are connected with a bridge rectifier BR. The DC output from bridge rectifier BR is applied to a B+ bus and a B− bus, with the B+ bus being of positive polarity.

A first filter capacitor FCa is connected between the B bus and a junction Jc; and a second filter capacitor FCb is connected between junction Jc and the B− bus.

A first switching transistor Qa is connected with its collector to the B+ bus and with its emitter to a junction Jq. A second switching transistor Qb is connected with its collector to junction Jq and with its emitter to the B− bus.

A first saturable current feedback transformer FTa has a primary winding FTap and a secondary winding FTas, which secondary winding is connected across the base-emitter junction of transistor Qa. A second saturable current feedback transformer FTb has a primary winding FTbp and a secondary winding FTbs, which secondary winding is connected across the base-emitter junction of transistor Qb.

A first thermal switch terminal TSta of thermal switch TS is connected with junction Jq by way of series-connected primary windings FTap and FTbp; a second thermal switch terminal TStb is connected with junction Jc by way of primary winding ATp of an auxiliary transformer AT; and a third thermal switch terminal TStc is connected with a junction Jcl by way of a tank inductor TL. A tank capacitor TC is connected between junction Jcl and junction Jc, as is also a Varistor V.

A resistor Rta is connected between the B+ bus and a junction Jta; a capacitor Cta is connected between Jta and the B− bus; a Diac Dta is connected between Jta and the base of transistor Qb; and a diode Dtb is connected with its anode to junction Jta and with its cathode to junction Jq.

Connected between junctions Jc and Jcl is a series-combination consisting of: i) primary winding CSTp of a current sensing transformer CST, and (ii) two series-connected fluorescent lamps FL1 and FL2.

Fluorescent lamp FL1 has a first thermionic cathode TC1a and a second thermionic cathode TC1b. Fluorescent lamp FL2 has a first thermionic cathode TC2*a* and a second thermionic cathode TC2*b*.

Auxiliary transformer AT has three secondary windings with output terminals referred to as a-a, b-b and c-c; which output terminals are respectively connected with: (i) the terminals of cathode TC1*a*, (ii) the parallel-connected terminals of cathodes TC1*b* and TC2*a*, and (iii) the terminals of cathode TC2*b*.

Tank inductor TL has an auxiliary winding AW, the terminals of which are connected between the B− bus and the anode of a diode Dtc. The cathode of diode Dtc is connected with a junction Jtb by way of a resistor Rtb. A capacitor Ctb is connected between junction Jtb and the B− bus.

A first auxiliary transistor Q1 is connected with its collector to junction Jtb and with its emitter to the B− bus. Its base is connected with the B− bus by way of secondary winding CSTs of transformer CST; across which secondary winding is connected a resistor Rtc.

A second auxiliary transistor Q2 is connected with its collector to the base of transistor Qb and with its emitter to the B− bus. Its base is connected with junction Jtb by way of a series-connection of a Diac Dtd and a resistor Rtd.

A third auxiliary transistor Q3 is connected with its collector to junction Jta and with its emitter to the B− bus. Its base is connected: (i) with junction Jtb by way of a resistor Rte, and (ii) with the B− bus by way of a resistor Rtf.

DETAILS OF OPERATION

In its basic operation, the half-bridge inverter of FIG. 1 —which principally consists of capacitors FCa/FCb, transistors Qa/Qb and transformers FTa/FTb—is substantially conventional and is explained in detail in conjunction with FIG. 8 of U.S. Pat. No. Re. 31,758 to Nilssen.

The L-C series-circuit consisting of tank inductor TL and tank capacitor TC is tuned to resonance at or near the inverter's frequency, which is approximately 30 kHz. The two fluorescent lamps are connected in parallel-circuit with the tank capacitor. Thus, the L-C circuit is series-excited (by a 30 kHz squarewave voltage from the inverter) and parallel-loaded (by a pair of series-connected fluorescent lamps).

When power is initially applied between the B+bus and the B− bus, thermal switch TS is in the position shown, thereby connecting auxiliary transformer AT with the inverter's output. A brief period after power is initially applied, the voltage on capacitor Cta reaches a magnitude high enough to cause Diac Dta to break down, thereby providing a trigger pulse to the base of transistor Qb. This trigger pulse triggers the inverter into self-oscillation.

Thus, with transformer AT connected with the inverter's output, heating power is provided to the lamps' cathodes by way of the three secondary windings a-a, b-b and c-c of AT. After about 1.5 second, the cathodes have become thermionic, thereby permitting the lamps to be ignited in ordinary Rapid-Start manner. At about that point, thermal switch TS—which by now has been self-heated for about 1.5 second by way of its own built-in heating element—switches into its other position, thereby disconnecting transformer AT from the inverter's output and connecting the L-C series-circuit to the inverter's output instead, thereby igniting the lamps.

As soon as the inverter's output is applied to the L-C series-circuit, a voltage is provided from auxiliary winding AW; which voltage is rectified and used for charging capacitor Ctb. After about 15 milli-seconds—except if overtly prevented from doing so by way of transistor Q1—the voltage on capacitor Ctb will reach a magnitude high enough to cause Diac Dtd to break down, thereby providing a current pulse to the base of transistor Q2; which, in turn, causes transistor Q2 to become highly conductive for a brief period, thereby to constitute a near short circuit across the base-emitter junction of transistor Qb, thereby bringing the inverter out of oscillation.

The inverter will now remain out of oscillation until provided with another trigger pulse at the base of transistor Qb. However, the voltage on capacitor Ctb remaining after the breakdown of Diac Dtd will—for about 5 seconds—remain high enough for to provide a current to forward-bias the base of transistor Q3.

Thus, for about 5 seconds, conduction by transistor Q3 will prevent capacitor Cta from charging up, thereby preventing the inverter from being triggered into oscillation again for about 5 seconds.

During this period of about 5 seconds, the thermal switch TS receives no heating power, thereby causing it to cool and —after a period of about 3 seconds—to disconnect the L-C circuit from the inverter output and to reconnect the auxiliary transformer therewith. Hence, by the time the inverter is triggered into oscillation again, the condition is the same as it was upon initial application of power to the inverter.

In other words, except if the lamps ignite within a relatively brief period (about 15 milli-seconds), the inverter will automatically shut itself off; and will remain off for a relatively long period (about 5 seconds) before being re-initiated into operation.

However, if the lamps do ignite within 15 milli-seconds, current sensing transformer CST will provide an output from its secondary winding, thereby causing transistor Q1 to conduct; which, in turn, will prevent capacitor Ctb from reaching a voltage high enough to cause Diac Dtd to break down. Thus, as long as the lamps ignite in a normal manner, the inverter will be prevented from its otherwise automatic self-quenching of operation.

On the other hand, is the lamps were to be removed from the circuit, or if they were to become inoperative, the current through the primary winding of sensing transformer CST will disappear, and the inverter will indeed become disabled within about 15 milli-seconds.

For the brief (about 15 milli-seconds) period of lamp ignition, the magnitude of the voltage developing across tank capacitor TC is limited by Varistor V; which Varistor, during this brief ignition period, will be subjected to a substantial degree of power dissipation. However, even if the lamps were to remain disconnected on a continuous basis, the maximum average power that can possibly be dissipated by the Varistor is limited by the nature of the duty-cycle of the inverter's automatic pre-heat, shut-down and re-trigger arrangement. For the particular values of 1.5 second for lamp cathode pre-heating, 15 milli-seconds for lamp ignition (or shut-down), and 5 seconds for reverting to original state, the maximum average Varistor dissipation is limited to about 0.25% of the level of power dissipation that occurs during the 15 milli-second ignition (or shut-down) period.

Additional Comments (a) More detailed information relative to a fluorescent lamp ballast wherein the fluorescent lamp is powered by way of a series-excited parallel-loaded L-C resonant circuit is provided in U.S. Pat. No. 4,554,487 to Nilssen.

(b) With respect to the circuit arrangement of FIG. 1, it is noted that mitigation of electric shock hazard is accomplished by locating the current sensing transformer (CST) on the "cold" side of the ballast output. That way, if a ground-connected person were to hold onto one end of a lamp whose other end were being inserted into a socket connected with the "hot" side of the ballast output, which represents the situation posing the greatest electric shock hazard, the inverter would be prevented from getting into a situation of providing current through that person on a continuous basis. Rather, if the inverter were indeed to become triggered into oscillation while the person were holding onto the one end of the lamp (with the other end connected with the "hot" side of the ballast output), lamp current could only flow through that person for a maximum period of about 15 milli-seconds.

On the other hand, if the current sensing transformer (CST) had been located on the "hot" side of the ballast output, no such shock mitigation would have been obtained.

The "hot" side of the ballast output refers to the side that has the larger RMS voltage magnitude with respect to ground; and the "cold" side refers to the side having the smaller RMS voltage magnitude with respect to ground.

Of course, with a lamp connected between ground and the "cold" side of the ballast output, no substantial lamp current will result.

(c) The thermal switch (TS) is of well known design. It is made to have two stable states and to switch between these two states in bi-stable manner. State No. 1, which is the state shown in FIG. 1, represents the state into which the switch will enter and wherein it will remain in the absence of applied power. State No. 2 represents the state into which the switch will enter and where it will remain in the presence of applied power.

The switch is activated by heat generated by a built-in heating element; which heating element is connected between terminal TSta and junction Jc, thereby being powered by the AC voltage provided between the inverter's output terminals.

(d) In case it were desired to provide cathode heating on a continuous basis, such could be accomplished very simply by making a permanent connection between terminal TSta and TStb.

(e) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. An arrangement comprising:

power supply operative to provide an AC voltage across a pair of output terminals, the power supply having disable means and being operative, on receipt of a disable signal by said disable means, to cease to provide said AC voltage;

disable signal means having prevention means and being connected in circuit with the output terminals, the disable signal means being responsive to the AC voltage and operative, except if provided with a prevent signal at its prevention means, to provide said disable signal, thereby to cause the power supply to cease to provide said AC voltage; and prevent signal means connected in circuit with the output terminals and responsive to current flowing therefrom, the prevent signal means being operative to provide said prevent signal as long as current flows from one of the output terminals.

2. An arrangement comprising:

inverter means connected with a source of DC voltage and operative, starting at a certain point of time, to provide an AC voltage at a pair of output terminals;

a first load means;

a second load means; and switch means connected in circuit between the output terminals and the two load means, the switch means being responsive to the AC voltage and operative to connect the two load means with the output terminals in such manner that: (i) the first load means starts receiving power from the output terminals at said certain point in time, and (ii) the second load means starts receiving power from the output terminals a brief period after said certain point in time.

3. The arrangement of claim 2 wherein the second load means comprises an L-C series-circuit resonant at or near the frequency of the AC voltage.

4. The arrangement of claim 2 combined with fluorescent lamp means having thermionic cathodes, the lamp means having a main power input, each thermionic cathode having a cathode heating power input, and wherein the first load means comprises the cathode heating power inputs of the thermionic cathodes and the second load means comprises the main power input of the fluorescent lamp.

5. The arrangement of claim 2 having means operative to prevent the first load from being connected with the output terminals at the same time as the second load means is connected therewith.

6. The arrangement of claim 2 wherein the inverter has a disable means and being operative, on receipt of a disable signal by the disable means, to become disabled and to cease to provide the AC voltage.

7. The arrangement of claim 6 having disable signal means responsive to the AC voltage, the disable signal means having prevent means and being operative, except if a prevent signal is being supplied to its prevent means, to provide the disable signal to the disable means, thereby to disable the inverter and to remove the AC voltage from the output terminals.

8. The arrangement of claim 7 combined with current sensing means connected in circuit with one of the output terminals and operative, in response to current flowing from said one output terminal, to supply said prevent signal.

9. The arrangement of claim 7 wherein the inverter is operative, after having been disabled and on receipt of an enabling signal, to again start providing the AC voltage.

10. The arrangement of claim 9 having enabling means operative to provide the enabling signal some time period after the inverter has become disabled.

11. The arrangement of claim 2 having means to remove the AC voltage from the output terminals, and wherein the switch means is operative, some brief time period after the AC voltage is removed from the output terminals, to disconnect the second load means from the output terminals and to reconnect the first load means thereto.

12. The arrangement of claim 2 wherein the first load means and the second load means are comprised within a single load entity having an auxiliary input and a main input corresponding respectively to the first load means and the second load means, and wherein power must be supplied for some period of time to the auxiliary input before the main input is properly operable to receive power.

13. An arrangement comprising:

a power supply operative, starting at a certain point in time, to provide an AC voltage at a pair of output terminals;

circuit means having: (i) fluorescent lamp means with thermionic cathode means and gas discharge means, (ii) cathode power input means connected with the thermionic cathode means and receptive of cathode heating power, and (iii) main lamp power input means connected with the gas discharge means and receptive of main lamp operating power; and switch means connected in circuit between the output terminals, the cathode power input means and the main lamp power input means, the switch means being operative: (i) to provide connection between the output terminals and the cathode power input means at said certain point in time, and (ii) to provide connection between the output terminals and the main lamp power input means, but not until a brief period of time after said certain point in time;

thereby to ensure that the cathode power input means will have received power for said brief period of time before connection is made between the output terminals and the main lamp power input means;

thereby, in turn, ensuring that the thermionic cathode means has become thermionic before supplying power to the gas discharge means.

14. The arrangement of claim 13 wherein:

(a) the main lamp power input means comprises a series-combination of an inductor and a capacitor, which series-combination is: (i) resonant at or near the frequency of the AC voltage, and (ii) after said brief period of time, connected across the output terminals; and (b) the gas discharge means is effectively connected in parallel with the capacitor.

15. The arrangement of claim 13 wherein the power supply: (i) is connected with an ordinary electric utility power line, and (ii) comprises frequency conversion means, thereby to make the frequency of the AC voltage substantially higher than that of the voltage on the power line.

16. The arrangement of claim 13 wherein the power supply: (i) has control input means receptive of a control input signal, and (ii) is operative to remove the AC voltage from the output terminals on receipt of the control input signal.

17. An arrangement comprising:

a source providing a DC voltage at a set of DC terminals;

inverter means connected with the DC terminals and operative to provide an AC voltage between a first AC terminal and a second AC terminal; the second AC terminal being connected with the DC terminals by way of a connection means having substantially no impedance at the frequency of the AC voltage; the inverter means having internally connected disable means operative on receipt of a disable action to reduce the magnitude of the AC voltage;

lamp means having a first lamp terminal and a second lamp terminal; the first lamp terminal being connected with the first AC terminal; and sensor means having sensor input terminals connected between the second lamp terminal and the second AC terminal; the sensor means: (i) being responsive to a sensor input current flowing between the sensor input terminals; (ii) having a sensor output connected with the disable means; and (iii) being operative, if the sensor input current were to have a magnitude below a certain level for longer than a brief period of time, to provide said disable action to the disable means.

18. An arrangement comprising:

a source providing a DC voltage at a set of DC terminals;

inverter means connected with the DC terminals and operative to provide an AC voltage between a first AC terminal and a second AC terminal; the second AC terminal being connected with one of the DC terminals by way of a connection means having negligible impedance at the frequency of the AC voltage; the inverter means having internally connected control means operative on receipt of a control action to reduce the magnitude of the AC voltage;

lamp means having a first lamp terminal and a second lamp terminal; the first lamp terminal being connected with the first AC terminal; and sensor means having sensor input terminals connected between the second lamp terminal and the second AC terminal; the sensor means; (i) being responsive to a sensor current flowing between the sensor input terminals; (ii) having a sensor output connected with the control means; and (iii) being operative, if the magnitude of the sensor current were to remain below a certain level for longer than a brief period of time, to provide the control action of the control means.

19. The arrangement of claim 18 further characterized as being functional, in case a short circuit were to be placed between the second lamp terminal and the second AC terminal, to cause a reduction in the magnitude of the AC voltage.

20. An arrangement comprising:

a source providing a DC voltage at a set of DC terminals;

inverter means connected with the DC terminals and operative to provide an AC voltage between a first AC terminal and a second AC terminal; the second AC terminal being connected with one of the DC terminals by way of a connection means having substantially negligible impedance at the frequency of the AC voltage; the inverter means having internally connected control means operative on receipt of a control action to reduce the magnitude of the AC voltage;

lamp means having a first lamp terminal and a second lamp terminal; the first lamp terminal being connected with the first AC terminal; and sensor means having sensor input terminals connected between the second lamp terminal and the second AC terminal; the sensor means: (i) being responsive to a sensor current flowing between the sensor input terminals; (ii) developing a voltage across the sensor input terminals in response to the flow of the sensor current; (iii) having a sensor output connected with the control means; and (iv) being operative, if the magnitude of the sensor input current were to remain below a certain level for longer than a brief period of time, to cause said disable action to be provided;

the arrangement being characterized by functioning such that the control action would be provided to the control means in the event that a short circuit were to be placed across the sensor input terminals.

* * * * *